US009023481B2

(12) United States Patent
Dolan

(10) Patent No.: US 9,023,481 B2
(45) Date of Patent: May 5, 2015

(54) ANODIZED COATING OVER ALUMINUM AND ALUMINUM ALLOY COATED SUBSTRATES AND COATED ARTICLES

(75) Inventor: Shawn E. Dolan, Sterling Heights, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/251,748

(22) Filed: Oct. 15, 2008

(65) Prior Publication Data

US 2009/0098373 A1 Apr. 16, 2009

Related U.S. Application Data

(60) Division of application No. 10/972,591, filed on Oct. 25, 2004, now Pat. No. 7,452,454, which is a continuation-in-part of application No. 10/162,965, filed on Jun. 5, 2002, now Pat. No. 6,916,414, which is a continuation-in-part of application No. 10/033,554, filed on Oct. 19, 2001, now abandoned, which is a continuation-in-part of application No. 09/968,023, filed on Oct. 2, 2001, now abandoned.

(51) Int. Cl.

| | |
|---|---|
| ***B32B 15/04*** | (2006.01) |
| ***C25D 11/08*** | (2006.01) |
| ***C25D 11/02*** | (2006.01) |
| ***C25D 5/18*** | (2006.01) |
| ***C25D 11/18*** | (2006.01) |
| ***C25D 11/14*** | (2006.01) |

(52) U.S. Cl.

CPC ..... *C25D 11/18* (2013.01); *C25D 11/08* (2013.01); *C25D 11/024* (2013.01); *C25D 5/18* (2013.01); *C25D 11/14* (2013.01)

(58) Field of Classification Search

None

See application file for complete search history.

(56) References Cited

U.S. PATENT DOCUMENTS

| | | | | | |
|---|---|---|---|---|---|
| 2,031,121 | A | | 5/1937 | Stareck | |
| 2,131,272 | A | | 2/1941 | Rothe | |
| 2,231,373 | A | | 2/1941 | Schenk | |
| 2,275,223 | A | | 3/1942 | Hardoen | |
| 2,305,669 | A | | 12/1942 | Budiloff et al. | |
| 2,573,229 | A | * | 10/1951 | Stern | 419/5 |
| 2,858,285 | A | * | 10/1958 | Johnson | 524/400 |
| 2,880,148 | A | | 3/1959 | Evangelides | |
| 2,901,409 | A | | 8/1959 | De Long | |
| 2,929,125 | A | | 2/1960 | Currah et al. | |
| 3,345,276 | A | | 10/1967 | Munroe | |
| 3,524,799 | A | * | 8/1970 | Howard | 205/330 |
| 3,620,940 | A | | 11/1971 | Wick | |
| 3,681,180 | A | * | 8/1972 | Kent | 428/189 |
| 3,729,391 | A | * | 4/1973 | Houghton et al. | 205/213 |
| 3,778,315 | A | * | 12/1973 | Booker et al. | 148/242 |
| 3,824,159 | A | * | 7/1974 | Wehrmann | 205/108 |
| 3,864,224 | A | | 2/1975 | Cotton et al. | |
| 3,865,560 | A | * | 2/1975 | Sabetay | 428/629 |
| 3,945,899 | A | | 3/1976 | Nikaido et al. | |
| 3,950,240 | A | | 4/1976 | Cookfair et al. | |
| 3,956,080 | A | | 5/1976 | Hradcovsky et al. | |
| 3,960,676 | A | | 6/1976 | Miyosawa et al. | |
| 3,996,115 | A | | 12/1976 | Kessler | |
| 4,082,626 | A | | 4/1978 | Hradcovsky | |
| 4,094,750 | A | | 6/1978 | Mackey | |
| RE29,739 | E | | 8/1978 | Kessler | |
| 4,110,147 | A | * | 8/1978 | Grunwald et al. | 156/307.5 |
| 4,113,596 | A | | 9/1978 | Jozwiak et al. | |
| 4,145,263 | A | | 3/1979 | Tsutsui et al. | |
| 4,166,777 | A | | 9/1979 | Casson, Jr. et al. | |
| 4,184,926 | A | | 1/1980 | Kozak | |
| 4,188,270 | A | | 2/1980 | Kataoka | |
| 4,200,475 | A | * | 4/1980 | Kasahara et al. | 148/244 |
| 4,227,976 | A | | 10/1980 | Menke | |
| 4,296,661 | A | | 11/1981 | Ikeno et al. | |
| 4,370,538 | A | | 1/1983 | Browning | |
| 4,383,897 | A | | 5/1983 | Gillich et al. | |
| 4,399,021 | A | | 8/1983 | Gillich et al. | |
| 4,401,489 | A | * | 8/1983 | Arai et al. | 148/438 |
| 4,439,287 | A | | 3/1984 | Birkle et al. | |
| 4,448,647 | A | | 5/1984 | Gillich et al. | |
| 4,452,674 | A | | 6/1984 | Gillich et al. | |
| 4,455,201 | A | | 6/1984 | Birkle et al. | |
| 4,456,663 | A | * | 6/1984 | Leonard | 428/653 |
| 4,473,110 | A | * | 9/1984 | Zawierucha | 165/133 |
| 4,511,633 | A | | 4/1985 | Bruno et al. | |
| 4,551,211 | A | | 11/1985 | Kobayashi et al. | |
| 4,578,156 | A | | 3/1986 | Plazter | |
| 4,579,786 | A | | 4/1986 | Nakakouji et al. | |

(Continued)

FOREIGN PATENT DOCUMENTS

| | | |
|---|---|---|
| CA | 2474367 A1 | 1/2006 |
| CA | 2479032 A1 | 3/2006 |

(Continued)

OTHER PUBLICATIONS

U.S. Appl. No. 12/492,319, filed Jun. 26, 2009, Dolan.

U.S. Appl. No. 12/510,665, filed Jul. 28, 2009, Dolan.

Zozulin, Alex J.; "A Chromate-Free Anodize Process for Magnesium Alloys. A Coating With Superior Characteristics", pp. 47-63.

Zozulin, et al; "Anodized Coatings for Magnesium Alloys", Metal Finishing, Mar. 1994, pp. 39-44.

IBM Techinical Disclosure Bulletin. "Forming Protective Coatings on Magnesium Alloys", Dec. 1967, p. 862.

Barton et al; "The Effect of Electrolyte on the Anodized Finish of a Magnesium Alloy": Plating & Surface Finishing, pp. 138-141.

(Continued)

*Primary Examiner* — Adam Krupicka

(74) *Attorney, Agent, or Firm* — Mary K. Cameron

(57) ABSTRACT

Using aqueous electrolytes containing complex fluorides or oxyfluorides such as fluorozirconates and fluorotitanates, ferrous metal articles and non-metallic articles having a first coating containing aluminum may be rapidly anodized to form a second protective surface coating. White coatings may be formed on articles using pulsed direct current or alternating current.

36 Claims, No Drawings

(56) References Cited

U.S. PATENT DOCUMENTS

| | | | | | |
|---|---|---|---|---|---|
| 4,620,904 | A | | 11/1986 | Kozak | |
| 4,659,440 | A | * | 4/1987 | Hradcovsky | 205/106 |
| 4,668,347 | A | | 5/1987 | Habermann et al. | |
| 4,705,731 | A | | 11/1987 | Saitoh et al. | |
| 4,744,872 | A | | 5/1988 | Kobayashi et al. | |
| 4,775,600 | A | | 10/1988 | Adaniya et al. | |
| 4,786,336 | A | * | 11/1988 | Schoener et al. | 148/247 |
| 4,839,002 | A | | 6/1989 | Pernick et al. | |
| 4,859,288 | A | | 8/1989 | Furneaux et al. | |
| 4,869,789 | A | | 9/1989 | Kurze et al. | |
| 4,869,936 | A | | 9/1989 | Moskowitz et al. | |
| 4,882,014 | A | | 11/1989 | Coyle et al. | |
| 4,976,830 | A | | 12/1990 | Schmeling et al. | |
| 4,978,432 | A | | 12/1990 | Schmeling et al. | |
| 5,032,129 | A | | 7/1991 | Kurze et al. | |
| 5,087,645 | A | | 2/1992 | Kojima et al. | |
| 5,100,486 | A | * | 3/1992 | Krikorian et al. | 148/248 |
| 5,102,746 | A | | 4/1992 | Shindou et al. | |
| 5,201,119 | A | | 4/1993 | Mizuno et al. | |
| 5,221,576 | A | | 6/1993 | Bosc et al. | |
| H1207 | H | * | 7/1993 | Smith | 205/50 |
| 5,240,589 | A | * | 8/1993 | Bartak et al. | 205/321 |
| 5,264,113 | A | | 11/1993 | Bartak et al. | |
| 5,266,412 | A | | 11/1993 | Bartak et al. | |
| 5,275,713 | A | | 1/1994 | Hradcovsky | |
| 5,281,282 | A | | 1/1994 | Dolan et al. | |
| 5,283,131 | A | | 2/1994 | Mori et al. | |
| 5,302,414 | A | | 4/1994 | Alkhimou et al. | |
| 5,314,334 | A | | 5/1994 | Panzera et al. | |
| 5,356,490 | A | | 10/1994 | Dolan et al. | |
| 5,385,662 | A | | 1/1995 | Kurze et al. | |
| 5,441,580 | A | | 8/1995 | Tomlinson | |
| 5,451,271 | A | | 9/1995 | Yoshida et al. | |
| 5,470,664 | A | | 11/1995 | Barlak et al. | |
| 5,478,237 | A | | 12/1995 | Ishizawa | |
| 5,583,704 | A | * | 12/1996 | Fujii | 359/884 |
| 5,700,366 | A | | 12/1997 | Steblianko et al. | |
| 5,759,251 | A | | 6/1998 | Nakamura et al. | |
| 5,775,892 | A | | 7/1998 | Miyasaka et al. | |
| 5,792,335 | A | | 8/1998 | Barton | |
| 5,811,194 | A | | 9/1998 | Kurze et al. | |
| 5,837,117 | A | | 11/1998 | Allegret | |
| 5,945,035 | A | | 8/1999 | Vogt et al. | |
| 5,958,604 | A | | 9/1999 | Riabkov et al. | |
| 5,981,084 | A | | 11/1999 | Riabkov et al. | |
| 6,030,526 | A | | 2/2000 | Porter | |
| 6,059,897 | A | | 5/2000 | Koerner et al. | |
| 6,068,890 | A | | 5/2000 | Kaumle et al. | |
| 6,082,444 | A | | 7/2000 | Harada et al. | |
| 6,090,490 | A | | 7/2000 | Mokerji | |
| 6,127,052 | A | | 10/2000 | Tomari | |
| 6,153,080 | A | | 11/2000 | Heimann et al. | |
| 6,159,618 | A | | 12/2000 | Danroc et al. | |
| 6,165,630 | A | * | 12/2000 | Gehlhaar et al. | 428/658 |
| 6,180,548 | B1 | | 1/2001 | Taoda et al. | |
| 6,197,178 | B1 | | 3/2001 | Patel et al. | |
| 6,245,436 | B1 | | 6/2001 | Boyle | |
| 6,280,598 | B1 | | 8/2001 | Barton et al. | |
| 6,335,099 | B1 | | 1/2002 | Higuchi et al. | |
| 6,372,115 | B1 | | 4/2002 | Miyasaka et al. | |
| 6,595,341 | B1 | * | 7/2003 | Venz | 192/85.53 |
| 6,599,618 | B1 | | 7/2003 | Simmon, Jr. | |
| 6,797,147 | B2 | | 9/2004 | Dolan | |
| 6,803,023 | B1 | | 10/2004 | Ohmori et al. | |
| 6,861,101 | B1 | | 3/2005 | Kowalsky et al. | |
| 6,863,990 | B2 | | 3/2005 | Wu et al. | |
| 6,869,703 | B1 | | 3/2005 | Spitsberg et al. | |
| 6,875,529 | B1 | | 4/2005 | Spitsberg et al. | |
| 6,896,970 | B2 | | 5/2005 | Mayzel | |
| 6,916,414 | B2 | | 7/2005 | Dolan | |
| 7,452,454 | B2 | | 11/2008 | Dolan | |
| 7,569,132 | B2 | | 8/2009 | Dolan | |
| 7,578,921 | B2 | | 8/2009 | Dolan | |
| 7,820,300 | B2 | | 10/2010 | Dolan | |
| 2001/0007714 | A1 | | 7/2001 | Gaboury et al. | |
| 2003/0000847 | A1 | | 1/2003 | Ostrovsky | |
| 2003/0070935 | A1 | | 4/2003 | Dolan | |
| 2003/0075453 | A1 | | 4/2003 | Dolan | |
| 2003/0079994 | A1 | * | 5/2003 | Dolan | 205/102 |
| 2003/0118664 | A1 | | 6/2003 | Trogolo et al. | |
| 2003/0150524 | A1 | | 8/2003 | Wichelhaus et al. | |
| 2004/0081881 | A1 | | 4/2004 | Vyas et al. | |
| 2004/0099535 | A1 | | 5/2004 | Schweinsberg et al. | |
| 2004/0129294 | A1 | | 7/2004 | Takamasa et al. | |
| 2004/0202890 | A1 | | 10/2004 | Kutilek et al. | |
| 2004/0245496 | A1 | | 12/2004 | Taoda et al. | |
| 2005/0175798 | A1 | | 8/2005 | Kurokawa et al. | |
| 2006/0099397 | A1 | | 5/2006 | Thierauf et al. | |
| 2007/0041893 | A1 | | 2/2007 | Holladay et al. | |
| 2007/0125520 | A1 | | 6/2007 | Nutsos | |
| 2007/0144914 | A1 | | 6/2007 | Schweinsberg et al. | |
| 2008/0014393 | A1 | | 1/2008 | Denome et al. | |
| 2008/0038144 | A1 | | 2/2008 | Maziasz et al. | |
| 2008/0248214 | A1 | | 10/2008 | Nie et al. | |
| 2009/0162563 | A1 | | 6/2009 | Schweinsberg et al. | |
| 2009/0258242 | A1 | | 10/2009 | Dolan | |
| 2010/0000870 | A1 | | 1/2010 | Dolan | |
| 2010/0252241 | A1 | | 10/2010 | McDermott et al. | |

FOREIGN PATENT DOCUMENTS

| | | | |
|---|---|---|---|
| CA | 2585278 | A1 | 5/2006 |
| CA | 2585283 | A1 | 5/2006 |
| CA | 2556869 | A1 | 2/2008 |
| CN | 1392284 | A | 1/2003 |
| DE | 3516411 | A1 | 11/1986 |
| DE | 289065 | A5 | 4/1991 |
| DE | 4104847 | A1 | 8/1992 |
| EP | 0259657 | A1 | 3/1988 |
| EP | 0594374 | A1 | 4/1994 |
| EP | 0823496 | A1 | 2/1998 |
| EP | 0978576 | A1 | 2/2000 |
| EP | 1002644 | A2 | 5/2000 |
| EP | 0780494 | B1 | 11/2002 |
| EP | 1407832 | A2 | 4/2004 |
| FR | 2549092 | A1 | 5/1983 |
| FR | 2657090 | A1 | 7/1991 |
| GB | 294237 | A | 9/1929 |
| GB | 493935 | A | 10/1938 |
| GB | 1051665 | A | 12/1966 |
| GB | 1319912 | A | 6/1973 |
| GB | 2158842 | A | 11/1985 |
| GB | 234681 | A | 5/2000 |
| JP | 5311133 | | 2/1978 |
| JP | 56152994 | A | 11/1981 |
| JP | 57057888 | A | 4/1982 |
| JP | 57060098 | A | 4/1982 |
| JP | 5713191 | A | 8/1982 |
| JP | 58001093 | A | 1/1983 |
| JP | 59016994 | A | 1/1984 |
| JP | 6387716 | A | 4/1988 |
| JP | 63100194 | A | 5/1988 |
| JP | 4308093 | A | 10/1992 |
| JP | 5287587 | A | 11/1993 |
| JP | 6173034 | A | 6/1994 |
| JP | 8506856 | T | 7/1996 |
| JP | 9503824 | T | 4/1997 |
| JP | 9176894 | A | 7/1997 |
| JP | 10018082 | A | 1/1998 |
| JP | 11043799 | A | 2/1999 |
| JP | 11324879 | A | 11/1999 |
| JP | 2000153390 | A | 6/2000 |
| JP | 2000248398 | A | 9/2000 |
| JP | 2000273656 | A | 10/2000 |
| JP | 3132133 | B2 | 2/2001 |
| JP | 2001201288 | A | 7/2001 |
| JP | 2003074932 | A | 3/2003 |
| JP | 2004052000 | A | 2/2004 |
| JP | 2004092931 | A | 3/2004 |
| JP | 2004-190121 | A | 7/2004 |
| RU | 2049162 | C1 | 11/1995 |
| RU | 2112087 | C1 | 5/1998 |
| RU | 2213166 | C2 | 9/2003 |
| SU | 617493 | A1 | 7/1978 |

(56) References Cited

FOREIGN PATENT DOCUMENTS

| | | | |
|---|---|---|---|
| WO | WO 92/14868 | A1 | 9/1992 |
| WO | WO 98/42892 | A1 | 10/1998 |
| WO | WO 98/42895 | A1 | 10/1998 |
| WO | WO 99/02759 | A1 | 1/1999 |
| WO | WO 00/03069 | A1 | 1/2000 |
| WO | WO 02/28838 | A2 | 4/2002 |
| WO | 03029528 | A1 | 4/2003 |
| WO | WO 03/029529 | A1 | 4/2003 |
| WO | WO 2006/047500 | A2 | 5/2006 |

OTHER PUBLICATIONS

Jakobson, et al: "Magnesium Anodizing", 85$^{th}$ American Electropiaters and Surface Finishers Society, pp. 541-549.
Yerokhin, A.L., et al, "Plasma Electrolysis for Surface Engineering", Surface and Coatings Technology 122, 1999, pp. 73-93.
Sworn Declaration of Dr. Peter Kurze dated Jul. 5, 2000, submitted in connection with PCT Publication WO 96/28591 of Magnesium Technology Limited.
Zhou, Y. et al, "Electrochemical Deposition and Microstructure of Copper (I) Oxide Films", Scripta Materials, vol. 38, No. 11 pp. 1731-1738 (1998).
Yoshimura et al, "Recent developments in soft, solution processing: one step fabrication of functional double oxide films by hydrothermal-electrochemical methods", Journal of Materials Chemistry, vol. 9, pp. 77-82 (1999).
International Search Report dated Feb. 26, 2007, PCT International Application PCT/US2005/038338.
Written Opinion dated Feb. 26, 2007, PCT International Application PCT/US2005/038338.
Supplementary European Search Report, EP 05 81 2094, dated May 3, 2010.

* cited by examiner

ANODIZED COATING OVER ALUMINUM AND ALUMINUM ALLOY COATED SUBSTRATES AND COATED ARTICLES

This application is a divisional application of application Ser. No. 10/972,591, filed Oct. 25, 2004 which is a continuation-in-part of application Ser. No. 10/162,965, filed Jun. 5, 2002, now U.S. Pat. No. 6,916,414, which is a continuation-in-part of application Ser. No. 10/033,554, filed Oct. 19, 2001, now abandoned, which is a continuation-in-part of application Ser. No. 09/968,023, filed Oct. 2, 2001, now abandoned, each of which are incorporated herein by reference.

FIELD OF THE INVENTION

This invention relates to the anodization of ferrous metal substrates that have a coating of predominantly aluminum alloy (e.g. Galvalume®) or aluminum to provide corrosion-, heat- and abrasion-resistant coated articles.

BACKGROUND OF THE INVENTION

Ferrous metal articles having a coating of metals that are dissimilar to the iron in the substrate on their surfaces have found a variety of industrial applications. The dissimilar metal coatings are typically comprised of aluminum either alone or aluminum in combination with other metals, such as zinc. This dissimilar metal coating provides corrosion protection to the ferrous metal substrate, but is itself subject to corrosion over time. Because of the dissimilar metal coating's tendency toward corrosion and environmental degradation, it is beneficial to provide the exposed surfaces of these metal articles with a secondary corrosion-resistant and protective coating. Such secondary coatings should resist abrasion so that the secondary and dissimilar metal coatings remain intact during use, where the metal article may be subjected to repeated contact with other surfaces, particulate matter and the like. Heat resistance is also a very desirable feature of a secondary protective coating. Where the appearance of the coated ferrous metal article is considered important, the secondary protective coating applied thereto should additionally be uniform and decorative.

In order to provide an effective and permanent protective coating on aluminum and its alloys, such metals have been anodized in a variety of electrolyte solutions, such as sulfuric acid, oxalic acid and chromic acid, which produce an alumina coating on the substrate. While anodization of aluminum and its alloys is capable of forming a more effective coating than painting or enameling, the resulting coated metals have still not been entirely satisfactory for their intended uses. The coatings frequently lack one or more of the desired degree of flexibility, hardness, smoothness, durability, adherence, heat resistance, resistance to acid and alkali attack, corrosion resistance, and/or imperviousness required to meet the most demanding needs of industry.

Anodization of ferrous metal substrates coated with an aluminum or aluminum alloy according to processes of the prior art results in an aluminum oxide coating that is brittle and requires subsequent sealing to provide a significant increase in corrosion protection. It is taught in the prior art that only certain metals, such as aluminum, magnesium, titanium and zinc, can be successfully anodized. It is also taught that electrically non-conductive substances, such as plastic, refractory materials and the like cannot be anodized.

Thus, there is still considerable need to develop alternative coating processes for non-conductive articles and ferrous metal articles having an aluminum or aluminum alloy metal coating which do not have any of the aforementioned shortcomings and yet still furnish corrosion-, heat- and abrasion-resistant protective coatings of high quality and pleasing appearance.

It will often be desirable to provide an anodized coating that not only protects the metal surface from corrosion but also provides a decorative white finish so that the application of a further coating of white paint or the like can be avoided. Few anodization methods are known in the art to be capable of forming a white-colored decorative finish with high hiding power on aluminum-coated ferrous metal substrates, for example.

SUMMARY OF THE INVENTION

Ferrous metal articles having a coating of aluminum or aluminum alloy, for example aluminum-zinc alloys, may be rapidly anodized to form protective coatings that are resistant to corrosion and abrasion using anodizing solutions containing complex fluorides and/or complex oxyfluorides. The anodizing solution is aqueous and comprises one or more components selected from water-soluble and water-dispersible complex fluorides and oxyfluorides of elements selected from the group consisting of Ti, Zr, Hf, Sn, Al, Ge and B. The use of the term "solution" herein is not meant to imply that every component present is necessarily fully dissolved and/or dispersed. Some anodizing solutions of the invention comprise a precipitate or develop a small amount of sludge in the bath during use, which does not adversely affect performance. In especially preferred embodiments of the invention, the anodizing solution comprises one or more components selected from the group consisting of the following:

a) water-soluble and/or water-dispersible phosphorus oxysalts, wherein the phosphorus concentration in the anodizing solution is at least 0.3M;
b) water-soluble and/or water-dispersible complex fluorides of elements selected from the group consisting of Ti, Zr, Hf, Sn, Al, Ge and B;
c) water-soluble and/or water-dispersible zirconium oxysalts;
d) water-soluble and/or water-dispersible vanadium oxysalts;
e) water-soluble and/or water-dispersible titanium oxysalts; water-soluble and/or water-dispersible alkali metal fluorides;
g) water-soluble and/or water-dispersible niobium salts;
h) water-soluble and/or water-dispersible molybdenum salts;
i) water-soluble and/or water-dispersible manganese salts;
j) water-soluble and/or water-dispersible tungsten salts; and
k) water-soluble and/or water-dispersible alkali metal hydroxides.

In another embodiment of the invention, niobium, molybdenum, manganese, and/or tungsten salts are co-deposited in a ceramic oxide film of zirconium and/or titanium.

The method of the invention comprises providing a cathode in contact with the anodizing solution, placing the article as an anode in the anodizing solution, and passing a current through the anodizing solution at a voltage and for a time effective to form the protective coating on the surface of the article. Pulsed direct current or alternating current is preferred. When using pulsed current, the average voltage is preferably not more than 250 volts, more preferably, not more than 200 volts, or, most preferably, not more than 175 volts, depending on the composition of the anodizing solution selected. The peak voltage, when pulsed current is being used, is desirably not more than 600, preferably 500, most preferably 400 volts. In one embodiment, the peak voltage for pulsed current is not more than, in increasing order of preference 600, 575, 550, 525, 500 volts and independently not less than 300, 310, 320, 330, 340, 350, 360, 370, 380, 390, 400 volts. When alternating current is being used, the voltage may range from about 200 to about 600 volts. In another alternating current embodiment, the voltage is, in increasing order of preference 600, 575, 550, 525, 500 volts and independently not less than 300, 310, 320, 330, 340, 350, 360, 370, 380, 390, 400 volts.

An object of the invention is to provide a method of forming a second protective coating on a surface of an article having a first protective coating comprising an aluminum or aluminum alloy coating by providing an anodizing solution comprised of water and one or more additional components selected from the group consisting of:

a) water-soluble complex fluorides, b) water-soluble complex oxyfluorides, c) water-dispersible complex fluorides, and d) water-dispersible complex oxyfluorides of elements selected from the group consisting of Ti, Zr, Hf, Sn, Al, Ge and B and mixtures thereof; providing a cathode in contact with said anodizing solution; placing an article having a first protective coating on at least one surface of the article comprising an aluminum or aluminum alloy as an anode in said anodizing solution; and passing a current between the anode and cathode through said anodizing solution for a time effective to form a second protective coating on the at least one surface having the first protective coating. The first protective coating can include aluminum, and/or alloys of aluminum, including aluminum-zinc alloys. The pH of the anodizing solution can be adjusted using ammonia, an amine, an alkali metal hydroxide or a mixture thereof.

It is a further object of the invention to provide such a method wherein the first protective coating is comprised of aluminum or aluminum and zinc, preferably the current is pulsed direct current or alternating current. A yet further object is to provide a method wherein the article is comprised of ferrous metal, preferably steel, the first protective coating is comprised of an aluminum-zinc alloy and the current is direct current. The current may be pulsed direct current. The average voltage of the pulsed direct current is generally not more than 200 volts.

It is a further object of the invention to provide a method wherein the second protective coating is formed at a rate of at least 1 micron thickness per minute.

It is a further object of the invention to provide a method wherein the anodizing solution is prepared using a complex fluoride selected from the group consisting of $H_2TiF_6$, $H_2ZrF_6$, $H_2HfF_6$, $H_2GeF_6$, $H_2SnF_6$, $H_3AlF_6$, $HBF_4$ and salts and mixtures thereof. The method may also include anodizing solutions additionally comprised of HF or a salt thereof and/or a chelating agent.

It is also an object of the invention is to provide a method of forming a second protective coating on an article comprised predominantly of ferrous material and having a first protective coating comprising aluminum, the method comprising: providing an anodizing solution comprised of water and a water-soluble complex fluoride and/or oxyfluoride of an element selected from the group consisting of Ti, Zr, and combinations thereof; providing a cathode in contact with the anodizing solution; placing an article comprised predominantly of ferrous material and having a first protective coating comprising aluminum, on at least one surface of the article, as an anode in the anodizing solution; and passing a pulsed direct current having an average voltage of not more than 170 volts or an alternating current between the anode and the cathode for a time effective to form the second protective coating on the surface having the first protective coating. A further object of this embodiment is to provide an anodizing solution prepared using a complex fluoride comprising an anion comprising at least 4 fluorine atoms and at least one atom selected from the group consisting of Ti, Zr, and combinations thereof preferably a complex fluoride selected from the group consisting of $H_2TiF_6$, $H_2ZrF_8$, and salts and mixtures thereof. It is a further object of the invention is to provide a method wherein the anodizing solution is comprised of at least one complex oxyfluoride prepared by combining at least one complex fluoride of at least one element selected from the group consisting of Ti and Zr and at least one compound which is an oxide, hydroxide, carbonate or alkoxide of at least one element selected from the group consisting of Ti, Zr, Hf, Sn, B, Al and Ge. It is a further object of this embodiment that the anodizing solution has a pH of from about 2 to about 6.

Another object of the invention is to provide a method of forming a second protective coating on a surface of an article having a first protective coating comprising an aluminum or aluminum alloy coating comprising: providing an anodizing solution having a pH of from about 2 to about 6, the anodizing solution having been prepared by dissolving a water-soluble complex fluoride, oxyfluoride, non-fluoride, water soluble salt or complex of an element selected from the group consisting of Ti, Zr, Hf, Sn, Ge, B, and mixtures thereof; providing a cathode in contact with the anodizing solution; placing the article having a first protective coating comprising an aluminum or aluminum alloy coating on at least one surface of the article as an anode in the anodizing solution; and passing a pulsed direct current having an average voltage of not more than 175 volts or an alternating current between the anode and the cathode for a time effective to form a second protective coating on the surface having the first protective coating. It is a further object of the invention that at least one compound which is an oxide, hydroxide, carbonate or alkoxide of at least one element selected from the group consisting of Ti, Zr, Hf, Sn, B, Al and Ge is additionally used to prepare the anodizing solution.

Another object of the invention is to provide a method of forming a white protective coating on a surface of an article having a first protective coating comprising aluminum which comprises providing an anodizing solution, the anodizing solution having been prepared by combining a water-soluble complex fluoride of zirconium or salt thereof, preferably $H_2ZrF_6$ or a salt thereof, and an oxide, hydroxide, carbonate or alkoxide of zirconium in water, preferably zirconium basic carbonate, and the anodizing solution having a pH of from about 3 to 5; providing a cathode in contact with the anodizing solution; placing the article having a first protective coating comprising aluminum as an anode in the anodizing solution; and passing a pulsed direct current having an average voltage of not more than 175 volts or an alternating current between the anode and the cathode for a time effective to form the white protective coating on the surface. It is a yet further object of the invention to provide a method wherein the anodizing solution has been prepared by combining about 0.1 to about 1 weight percent zirconium basic carbonate and about 10 to about 16 weight percent $H_2ZrF_6$ or salt thereof in water and adding a base if necessary to adjust the pH of the anodizing solution to between about 3 and about 5. It is preferred that the first protective coating additionally comprises zinc.

In is another object of the invention to provide products made according to the afore-described processes.

It is another object of the invention to provide an article of manufacture comprising a substrate having at least one surface comprised predominantly of a material selected from the group consisting of non-aluminiferous, non-magnesiferous metal and non-metal materials and combinations thereof; a first protective layer comprising aluminum applied to said at least one surface in a molten state and allowed to cool to a solid adherent state; a corrosion-resistant, uniform, adherent second protective layer comprising oxides of Ti, Zr, Hf, Sn, Al, Ge and B and mixtures thereof deposited on said first protective layer, preferably zirconium and/or titanium oxide. The substrate may be comprised predominantly of a ferrous metal, such as steel, or comprised of non-metal materials selected from the group consisting of polymeric and refractory material. It is a further object of the invention to provide the article having a first protective layer and a second protective layer as described herein further comprising a layer of paint or porcelain on the second protective layer.

DETAILED DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the scope of the invention. Practice within the numerical limits stated is generally preferred, however. Also, throughout the description, unless expressly stated to the contrary: percent, "parts of", and ratio values are by weight or mass; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) between one or more newly added constituents and one or more constituents already present in the composition when the other constituents are added; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise, such counterions may be freely selected, except for avoiding counterions that act adversely to an object of the invention; the term "paint" and its grammatical variations includes any more specialized types of protective exterior coatings that are also known as, for example, lacquer, electropaint, shellac, top coat, base coat, color coat, and the like; the word "mole" means "gram mole", and the word itself and all of its grammatical variations may be used for any chemical species defined by all of the types and numbers of atoms present in it, irrespective of whether the species is ionic, neutral, unstable, hypothetical or in fact a stable neutral substance with well defined molecules; and the terms "solution", "soluble", "homogeneous", and the like are to be understood as including not only true equilibrium solutions or homogeneity but also dispersions.

The workpiece to be subjected to anodization in accordance with the present invention is comprised predominantly of a material other than aluminum or magnesium. This material can be ferrous metal, non-ferrous metal or a non-metallic material, provided that, after coating with the first protective coating, the material does not interfere with the electrical conductivity of the article required for anodic reactions. The workpiece or article additionally comprises a first protective coating comprising aluminum or an aluminum, preferably aluminum-zinc, alloy. By way of non-limiting example, suitable substrates include aluminized steel which comprises a steel substrate having a first protective coating of aluminum thereon and aluminum-zinc alloy coated steel, e.g. GALVALUME® a 55% Al—Zn alloy coated sheet steel manufactured and sold by International Steel Group, Dofasco Inc., United States Steel Corp., and Wheeling-Nisshin, Inc. Other examples are manufactured and sold by Steelscape Inc. under the registered trademark Zincalume®, by Industrias Monterrey S.A. under its trademark Zintro-Alum™ and by Galvak S.A.de under its trademark Galval™.

In one embodiment, the first protective coating is a metal that contains not less than, in increasing order of preference, 30, 40, 50, 60, 70, 80, 90, 100% by weight aluminum. In an another embodiment it is preferred that the first protective coating comprise an alloy wherein the amount of aluminum is preferably not less than 30% by weight, and is not more than 70% by weight, most preferably 40 to 60 wt %. In a third embodiment, the first protective coating is predominantly comprised of zinc, and aluminum comprises not more than 10 wt %, 7 wt % or 5 wt %.

In carrying out the anodization of a workpiece, an anodizing solution is employed which is preferably maintained at a temperature between about 0° C. and about 90° C. It is desirable that the temperature be at least about, in increasing order of preference 5, 10, 15, 20, 25, 30, 40, 50° C. and not more than 90, 88, 86, 84, 82, 80, 75, 70, 65° C.

The anodization process comprises immersing at least a portion of the workpiece having a first protective coating in the anodizing solution, which is preferably contained within a bath, tank or other such container. The article having a first protective coating (workpiece) functions as the anode. A second metal article that is cathodic relative to the workpiece is also placed in the anodizing solution. Alternatively, the anodizing solution is placed in a container that is itself cathodic relative to the workpiece (anode). When using pulsed current, an average voltage potential not in excess of in increasing order of preference 250 volts, 200 volts, 175 volts, 150 volts, 125 volts is then applied across the electrodes until a coating of the desired thickness is formed on the surface of the article in contact with the anodizing solution. The result is an article having a substrate that is typically not amenable to anodization, for example ferrous metal or non-metallic substrate, which now has at least one surface comprising a protective coating that includes an anodized layer comprising oxides of metals from the anodizing solution. When certain anodizing solution compositions are used, good results may be obtained even at average voltages not in excess of 100 volts. It has been observed that the formation of a corrosion- and abrasion-resistant protective coating is often associated with anodization conditions which are effective to cause a visible light-emitting discharge (sometimes referred to herein as a 'plasma', although the use of this term is not meant to imply that a true plasma exists) to be generated (either on a continuous or intermittent or periodic basis) on the surface of the article.

It is desirable that the current be pulsed or pulsing current. Direct current is preferably used, although alternating current may also be utilized (under some conditions, however, the rate of coating formation may be lower using AC). The frequency of the current may range from about 10 to 10,000 Hertz.

In a preferred embodiment, the current is a nominal square wave form. The "off" time between each consecutive voltage pulse preferably lasts between about 10% as long as the voltage pulse and about 1000% as long as the voltage pulse. During the "off" period, the voltage need not be dropped to zero (i.e., the voltage may be cycled between a relatively low baseline voltage and a relatively high ceiling voltage). The baseline voltage thus may be adjusted to a voltage that is from 0% to 99.9% of the peak applied ceiling voltage. Low baseline voltages (e.g., less than 30% of the peak ceiling voltage) tend to favor the generation of a periodic or intermittent visible light-emitting discharge, while higher baseline voltages (e.g., more than 60% of the peak ceiling voltage) tend to result in continuous plasma anodization (relative to the human eye frame refresh rate of 0.1-0.2 seconds). The current can be pulsed with either electronic or mechanical switches activated by a frequency generator. The average amperage per square foot is at least in increasing order of preference 10, 20, 30, 40, 50, 60, 70, 80, 90, 100, 105, 110, 115, and not more than at least for economic considerations in increasing order of preference 300, 275, 250, 225, 200, 180, 170, 160, 150, 140, 130, 125. More complex waveforms may also be employed, such as, for example, a DC signal having an AC component. Alternating current may also be used, with voltages desirably between about 200 and about 600 volts. The higher the concentration of the electrolyte in the anodizing solution, the lower the voltage can be while still depositing satisfactory coatings.

A number of different types of anodizing solutions may be successfully used in the process of this invention, as will be described in more detail hereinafter. However, it is believed that a wide variety of water-soluble or water-dispersible anionic species containing metal, metalloid, and/or non-metal elements are suitable for use as components of the anodizing solution. Representative elements include, for example, phosphorus, titanium, zirconium, hafnium, tin, germanium, boron, vanadium, fluoride, zinc, niobium, molybdenum, manganese, tungsten and the like (including combinations of such elements). In a preferred embodiment of the invention, the components of the anodizing solution are titanium and/or zirconium.

Without wishing to be bound by theory, it is thought that the anodization of ferrous metal articles having a dissimilar metal coating in the presence of complex fluoride or oxyfluoride species to be described subsequently in more detail leads to the formation of surface films comprised of metal/metalloid oxide ceramics (including partially hydrolyzed glasses containing O, OH and/or F ligands) or metal/non-metal compounds wherein the metal comprising the surface film includes metals from the complex fluoride or oxyfluoride species and metals from the dissimilar metals comprising the first protective coating. The plasma or sparking which often occurs during anodization in accordance with the present invention is believed to destabilize the anionic species, causing certain ligands or substituents on such species to be hydrolyzed or displaced by O and/or OH or metal-organic bonds to be replaced by metal-O or metal-OH bonds. Such hydrolysis and displacement reactions render the species less water-soluble or water-dispersible, thereby driving the formation of the surface coating of oxide that forms the second protective coating. In situ generation of oxygen peroxides and oxygen radicals in the area of the anode is also thought to contribute to the hydrolysis of the complex.

The anodizing solution used comprises water and at least one complex fluoride or oxyfluoride of an element selected from the group consisting of Ti, Zr, Hf, Sn, Al, Ge and B (preferably, Ti and/or Zr). The complex fluoride or oxyfluoride should be water-soluble or water-dispersible and preferably comprises an anion comprising at least 1 fluorine atom and at least one atom of an element selected from the group consisting of Ti, Zr, Hf, Sn, Al, Ge or B. The complex fluorides and oxyfluorides (sometimes referred to by workers in the field as "fluorometallates") preferably are substances with molecules having the following general empirical formula (I):

$$HpTqFrOs \quad (I)$$

wherein: each of p, q, r, and s represents a non-negative integer; T represents a chemical atomic symbol selected from the group consisting of Ti, Zr, Hf, Sn, Al, Ge, and B; r is at least 1; q is at least 1; and, unless T represents B, (r+s) is at least 6. One or more of the H atoms may be replaced by suitable cations such as ammonium, metal, alkaline earth metal or alkali metal cations (e.g., the complex fluoride may be in the form of a salt, provided such salt is water-soluble or water-dispersible).

Illustrative examples of suitable complex fluorides include, but are not limited to, $H_2TiF_6$, $H_2ZrF_6$, $H_2HfF_6$, $H_2GeFe_6$, $H_2SnF_6$, $H_3AlF_6$, $HBF_4$ and salts (fully as well as partially neutralized) and mixtures thereof. Examples of suitable complex fluoride salts include $SrZrF_6$, $MgZrF_6$, $Na_2ZrF_6$ and $Li_2ZrF_6$, $SrTiF_6$, $MgTiF_6$, $Na_2TiF_6$ and $Li_2Ti\ F_6$.

The total concentration of complex fluoride and complex oxyfluoride in the anodizing solution preferably is at least about 0.005 M. Generally, there is no preferred upper concentration limit, except of course for any solubility constraints. It is desirable that the total concentration of complex fluoride and complex oxyfluoride in the anodizing solution be at least 0.005, 0.010, 0.020, 0.030, 0.040, 0.050, 0.060, 0.070, 0.080, 0.090, 0.10, 0.20, 0.30, 0.40, 0.50, 0.60 M, and if only for the sake of economy be not more than, in increasing order of preference 2.0, 1.5, 1.0, 0.80 M.

To improve the solubility of the complex fluoride or oxyfluoride, especially at higher pH, it may be desirable to include an inorganic acid (or salt thereof) that contains fluorine but does not contain any of the elements Ti, Zr, Hf, Sn, Al, Ge or B in the electrolyte composition. Hydrofluoric acid or a salt of hydrofluoric acid such as ammonium bifluoride is preferably used as the inorganic acid. The inorganic acid is believed to prevent or hinder premature polymerization or condensation of the complex fluoride or oxyfluoride, which otherwise (particularly in the case of complex fluorides having an atomic ratio of fluorine to "T" of 6) may be susceptible to slow spontaneous decomposition to form a water-insoluble oxide. Certain commercial sources of hexafluorotitanic acid and hexafluorozirconic acid are supplied with an inorganic acid or salt thereof, but it may be desirable in certain embodiments of the invention to add still more inorganic acid or inorganic salt.

A chelating agent, especially a chelating agent containing two or more carboxylic acid groups per molecule such as nitrilotriacetic acid, ethylene diamine tetraacetic acid, N-hydroxyethyl-ethylenediamine triacetic acid, or diethylene-triamine pentaacetic acid or salts thereof may also be included in the anodizing solution. Other Group IV compounds may be used, such as, by way of non-limiting example, Ti and/or Zr oxalates and/or acetates, as well as other stabilizing ligands, such as acetylacetonate, known in the art that do not interfere with the anodic deposition of the anodizing solution and normal bath lifespan. In particular, it is necessary to avoid organic materials that either decompose or polymerize without desirable effect in the energized anodizing solution.

Suitable complex oxyfluorides may be prepared by combining at least one complex fluoride with at least one compound which is an oxide, hydroxide, carbonate, carboxylate or alkoxide of at least one element selected from the group consisting of Ti, Zr, Hf, Sn, B, Al, or Ge. Examples of suitable compounds of this type that may be used to prepare the anodizing solutions of the present invention include, without limitation, zirconium basic carbonate, zirconium acetate and zirconium hydroxide. The preparation of complex oxyfluorides suitable for use in the present invention is described in U.S. Pat. No. 5,281,282, incorporated herein by reference in its entirety. The concentration of this compound used to make up the anodizing solution is preferably at least, in increasing preference in the order given, 0.0001, 0.001 or 0.005 moles/kg (calculated based on the moles of the element(s) Ti, Zr, Hf, Sn, B, Al and/or Ge present in the compound used). Independently, the ratio of the concentration of moles/kg of complex fluoride to the concentration in moles/kg of the oxide, hydroxide, carbonate or alkoxide compound preferably is at least, with increasing preference in the order given, 0.05:1, 0.1:1, or 1:1.

A pH adjuster may be present as in the anodizing solution, suitable pH adjusters include, by way of nonlimiting example, ammonia, amine, alkali metal hydroxide or other base. The amount of pH adjuster is limited to the amount required to achieve the desired pH and is dependent upon the type of electrolyte used in the anodizing bath. In a preferred embodiment, the amount of pH adjuster is less than 1% w/v. In general, it will be preferred to maintain the pH of the anodizing solution in this embodiment of the invention mildly acidic (e.g., a pH of from about 2.5 to about 5.5, preferably from about 3 to about 5).

In certain embodiments of the invention, the anodizing solution is essentially (more preferably, entirely) free of chromium, permanganate, borate, sulfate, free fluoride and/or free chloride.

Rapid coating formation is generally observed at average voltages of 175 volts or less (preferably 100 or less), using pulsed DC. It is desirable that the average voltage be of sufficient magnitude to generate coatings of the invention at a rate of at least about 1 micron thickness per minute, preferably at least 3-8 microns in 3 minutes. If only for the sake of economy, it is desirable that the average voltage be less than, in increasing order of preference, 275, 250, 225, 200, 175, 150, 140, 130, 125, 120, 115, 110, 100, 90 volts. Coatings of the invention are typically fine-grained and desirably are at least 1 micron thick, preferred embodiments have coating thicknesses from 1-20 microns. Thinner or thicker coatings may be applied, although thinner coatings may not provide the desired coverage of the article. Without being bound by a single theory, it is believed that, particularly for insulating oxide films, as the coating thickness increases the film deposition rate is eventually reduced to a rate that approaches zero asymptotically. Add-on mass of coatings of the invention ranges from approximately 5-200 $g/m^2$ or more and is a function of the coating thickness and the composition of the coating. It is desirable that the add-on mass of coatings be at least, in increasing order of preference, 5, 10, 11, 12, 14, 16, 18, 20, 25, 30, 35, 40, 45, 50 $g/m^2$.

A particularly preferred anodizing solution for use in forming a white protective coating on an aluminum or aluminum alloy substrate may be prepared using the following components:

| | |
|---|---|
| Zirconium Basic Carbonate | 0.01 to 1 wt. % |
| $H_2ZrF_6$ | 0.1 to 5 wt. % |
| Water | Balance to 100% |

pH adjusted to the range of 2 to 5 using ammonia, amine or other base.

In a preferred embodiment utilizing zirconium basic carbonate and $H_2ZrF_6$, it is desirable that the anodizing solution comprise zirconium basic carbonate in an amount of at least, in increasing order of preference 0.05, 0.10, 0.15, 0.20, 0.25, 0.30, 0.35, 0.40, 0.45, 0.50, 0.55, 0.60 wt. % and not more than, in increasing order of preference 1.0, 0.97, 0.95, 0.92, 0.90, 0.87, 0.85, 0.82, 0.80, 0.77 wt. %. In this embodiment, it is desirable that the anodizing solution comprises $H_2ZrF_6$ in an amount of at least, in increasing order of preference 0.2, 0.4, 0.6, 0.8, 1.0, 1.2, 1.3, 1.4, 1.5, 2.0, 2.5, 3.0, 3.5, wt. % and not more than, in increasing order of preference 10, 9.75, 9.5, 9.25, 9.0, 8.75, 8.5, 8.25, 8.0, 7.75 4.0, 4.5, 5.0, 5.5, 6.0 wt. %.

In a particularly preferred embodiment the amount of zirconium basic carbonate ranges from about 0.75 to 0.25 wt. %, the $H_2ZrF_6$ ranges from 6.0 to 9.5 wt %; a base such as ammonia is used to adjust the pH to ranges from 3 to 5.

It is believed that the zirconium basic carbonate and the hexafluorozirconic acid combine to at least some extent to form one or more complex oxyfluoride species. The resulting anodizing solution permits rapid anodization of articles using pulsed direct current having an average voltage of not more than 250 volts. In this particular embodiment of the invention, better coatings are generally obtained when the anodizing solution is maintained at a relatively high temperature during anodization (e.g., 40 degrees C. to 80 degrees C.). Alternatively, alternating current preferably having a voltage of from 300 to 600 volts may be used. The solution has the further advantage of forming protective coatings that are white in color, thereby eliminating the need to paint the anodized surface if a white decorative finish is desired. The anodized coatings produced in accordance with this embodiment of the invention typically have L values of at least 80, high hiding power at coating thicknesses of 4 to 8 microns, and excellent corrosion resistance. To the best of the inventor's knowledge, no anodization technologies being commercially practiced today are capable of producing coatings having this desirable combination of properties on aluminum or aluminum alloy coated ferrous metals and non-metals.

Before being subjected to anodic treatment in accordance with the invention, the ferrous metal articles having a dissimilar metal coating preferably is subjected to a cleaning and/or degreasing step. For example, the article may be chemically degreased by exposure to an alkaline cleaner such as, for example, a diluted solution of PARCO Cleaner 305 (a product of the Henkel Surface Technologies division of Henkel Corporation, Madison Heights, Mich.). After cleaning, the article preferably is rinsed with water. Cleaning may then, if desired, be followed by deoxidizing using one of the many commercially available deoxidizing solutions known in the art run according to the manufacturer's specification. Suitable nonlimiting examples of deoxidizing solutions include Deoxalume 2310 and SC 592 available from Henkel Corporation. Such pre-anodization treatments are well known in the art; typically, Galvalume® does not require deoxidizing.

The protective coatings produced on the surface of the workpiece may, after anodization, be subjected to still further treatments such as painting, sealing and the like. For example, a dry-in-place coating such as a silicone or a polyurethane waterborne dispersion may be applied to the anodized surface, typically at a film build (thickness) of from about 3 to about 30 microns.

The invention will now be further described with reference to a number of specific examples, which are to be regarded solely as illustrative and not as restricting the scope of the invention.

EXAMPLES

Example 1

An anodizing solution was prepared using the following components:

| | Parts per 1000 g |
|---|---|
| Zirconium Basic Carbonate | 5.5 |
| Fluorozirconic Acid (20% solution) | 84.25 |
| Deionized Water | 910.25 |

The pH was adjusted to 3.5 using ammonia. Test panels of Galvalume® were subjected to anodization for 3 minutes in the anodizing solution using pulsed direct current having a peak ceiling voltage of 500 volts (approximate average voltage=130 volts). The wave shape of the current was nominally a square wave. The "on" time was 10 milliseconds, the "off" time was 30 milliseconds (with the "off" or baseline voltage being 0% of the peak ceiling voltage). Coatings of 3-7 microns in thickness were formed on the surface of the Galvalume® test panels. The adherent, smooth coatings had a uniform white appearance.

Example 2

The test panels of Example 1 were analyzed using qualitative energy dispersive spectroscopy and found to comprise a coating comprised predominantly of zirconium and oxygen.

A test panel was subjected to salt fog testing (ASTM B-117-03) for 1000 hours. A scribe, i.e. a linear scratch, was made through the anodized coating and down to the aluminum-zinc alloy coating prior to exposure to the salt fog environment. The test panel was exposed to 1000 hours of salt fog testing which resulted in no scribe or field corrosion. This is an improvement over known paint films of 25 microns or more which, when subjected to 1000 hours of salt fog show scribe corrosion.

Although the invention has been described with particular reference to specific examples, it is understood that modifications are contemplated. Variations and additional embodiments of the invention described herein will be apparent to those skilled in the art without departing from the scope of the invention as defined in the claims to follow. The scope of the invention is limited only by the breadth of the appended claims.

What is claimed is:

1. An article of manufacture comprising:

a substrate having at least one surface comprised predominantly of combinations of non-aluminiferous, non-magnesiferous metal materials and non-metal materials;

a first protective layer comprising not less than 30 wt % aluminum applied to said at least one surface;

a second protective layer comprising a corrosion-resistant, uniform, adherent anodized coating comprised predominantly of oxides of elements selected from the group consisting of Ti, Zr, Hf, Sn, Ge and B and mixtures thereof deposited on said first protective layer wherein the second protective layer is generated through anodization of the first protective layer in the presence of complex fluoride or oxyfluoride species leading to formation of surface films comprised of metals from the complex fluoride or oxyfluoride species and metals taken from the first protective coating such that said second protective layer has flexibility that passes a 0-4 T-bend test.

2. The article of claim 1 wherein the corrosion-resistant, adherent second protective layer comprises titanium dioxide.

3. The article of claim 1 wherein the second protective layer has a thickness of 1-20 microns and the article has a corrosion resistance resulting in no scribe corrosion in salt fog testing according to ASTM B-117-03 of 1000 hours.

4. The article of claim 1 wherein the second protective layer comprises predominantly zirconium oxide and has an L value of at least 80, at coating thicknesses of 4 to 8 microns.

5. The article of claim 1 wherein the surface is comprised of the combinations of ferrous metal materials and non-metal materials; said non-metal materials being selected from the group consisting of polymeric and refractory material.

6. The article of claim 5 wherein the corrosion-resistant, adherent second protective layer comprises titanium dioxide.

7. The article of claim 5 wherein the non-metal materials are polymeric.

8. The article of claim 5 wherein the non-metal materials are refractory materials.

9. The article of claim 1 further comprising a layer of paint or porcelain on the second protective layer.

10. The article of claim 1 further comprising a dry-in-place coating on the second protective layer.

11. The article of claim 1 wherein the second protective layer further comprises niobium, molybdenum, manganese, and/or tungsten.

12. The article of claim 1 wherein the non-metal materials comprise refractory materials.

13. The article of claim 1 wherein the non-metal materials comprise polymeric materials.

14. An article of manufacture comprising:

a) a substrate having at least one surface comprised predominantly of a material selected from the group consisting of non-aluminiferous, non-magnesiferous metal materials and non-metal materials and combinations thereof;

b) a first protective layer comprising not less than 30 wt % aluminum applied to said at least one surface;

c) a second protective layer comprising a corrosion-resistant, uniform, adherent anodized coating comprised predominantly of oxides of elements selected from the group consisting of Ti, Zr, Hf, Sn, Ge and B and mixtures thereof deposited on said first protective layer wherein the second protective layer is generated through anodization of the first protective layer in the presence of complex fluoride or oxyfluoride species leading to formation of surface films comprised of metals from the complex fluoride or oxyfluoride species and metals taken from the first protective coating such that said second protective layer has flexibility that passes a 0-4 T-bend test; and wherein the second protective layer further comprises niobium, molybdenum, manganese, and/or tungsten.

15. The article of claim 14 wherein the corrosion-resistant, adherent second protective layer comprises titanium dioxide.

16. The article of claim 14 wherein the non-metal materials are present in a) and comprise refractory materials.

17. The article of claim 14 wherein the non-metal materials are present in a) and comprise polymeric materials.

18. The article of claim 14 wherein the first protective layer further comprises zinc.

19. The article of claim 14 wherein the surface is comprised predominantly of a ferrous metal.

20. The article of claim 14 wherein the corrosion-resistant, adherent second protective layer comprises zirconium oxide.

21. An article of manufacture comprising:

a) a substrate having at least one surface comprised predominantly of:

a combination of non-metal materials and non-aluminiferous, non-magnesiferous metal materials;

b) a first protective layer comprising not less than 30 wt % aluminum applied to said at least one surface;

c) a second protective layer comprising a corrosion-resistant, uniform, adherent anodized coating comprised predominantly of oxides of elements selected from the group consisting of Ti, Zr, Hf, Sn, Ge and B and mixtures thereof deposited by anodization of the first protective layer;

wherein the second protective layer has a thickness of 1-20 microns.

22. The article of claim 21 wherein the non-metal materials are selected from the group consisting of polymeric and refractory material.

23. The article of claim 21 wherein the corrosion-resistant, adherent second protective layer comprises titanium dioxide and the article has a corrosion resistance resulting in no scribe corrosion in salt fog testing according to ASTM B-117-03 of 1000 hours.

24. The article of claim 21 further comprising a layer of paint or porcelain on the second protective layer.

25. The article of claim 21 further comprising a dry-in-place coating on the second protective layer.

26. The article of claim 21 wherein the second protective layer further comprises niobium, molybdenum, manganese, and/or tungsten.

27. The article of claim 21 wherein the non-metal materials comprise refractory materials.

28. The article of claim 21 wherein the non-metal materials comprise polymeric materials.

29. The article of claim 21 wherein the corrosion-resistant, adherent second protective layer comprises zirconium oxide.

30. An article of manufacture comprising:

a substrate having at least one surface comprised predominantly of non-metal materials;

a) a first protective layer comprising not less than 30 wt % aluminum applied to said at least one surface;

b) a second protective layer comprising a corrosion-resistant, uniform, adherent anodized coating comprised predominantly of oxides of elements selected from the group consisting of Ti, Zr, Hf, Sn, Ge and B and mixtures thereof deposited by anodization of the first protective layer;

wherein the second protective layer has a thickness of 1-20 microns and the non-metal materials are refractory materials.

31. The article of claim 30 wherein the non-metal materials further comprise polymeric materials.

32. The article of claim 30 wherein the corrosion-resistant, adherent second protective layer comprises titanium dioxide.

33. The article of claim 30 wherein the corrosion-resistant, adherent second protective layer comprises zirconium oxide.

34. The article of claim 30 further comprising a layer of paint or porcelain on the second protective layer.

35. The article of claim 30 further comprising a dry-in-place coating on the second protective layer.

36. The article of claim 30 wherein the second protective layer further comprises niobium, molybdenum, manganese, and/or tungsten.

* * * * *